United States Patent [19]

Pagani

[11] 4,373,716

[45] Feb. 15, 1983

[54] EXERCISING DEVICE

[76] Inventor: Franco Pagani, 1100 Newportville Rd., Apt. 908, Croydon, Pa. 19020

[21] Appl. No.: 104,248

[22] Filed: Dec. 17, 1979

[51] Int. Cl.[3] ..... A63B 21/04

[52] U.S. Cl. ..... 272/137; 272/73; 272/142; 272/143; 272/900

[58] Field of Search ..... 272/73, 93, 126, 134–144

[56] References Cited

U.S. PATENT DOCUMENTS

| | | | |
|---|---|---|---|
| 605,237 | 6/1898 | Spink | 272/136 |
| 741,966 | 10/1903 | Hernshein | 272/143 |
| 1,623,670 | 4/1927 | Frankenfeld | 272/138 |
| 2,668,709 | 2/1954 | Boyko | 272/134 X |
| 2,724,592 | 11/1955 | Pfaus | 272/144 |
| 3,212,429 | 11/1965 | Shaboo et al. | 272/139 |
| 3,268,225 | 8/1966 | Kolbel | 272/143 |
| 3,369,809 | 2/1968 | Morrill | 272/138 |
| 3,589,721 | 6/1971 | Cronauer | 272/137 |
| 3,606,321 | 9/1971 | Macoulis | 272/135 |
| 3,746,339 | 7/1973 | Cox | 272/143 |
| 3,982,756 | 9/1976 | Hersey et al. | 272/134 X |
| 4,057,246 | 11/1977 | Wilson | 272/135 |
| 4,170,351 | 10/1979 | Ozbey et al. | 272/143 X |

FOREIGN PATENT DOCUMENTS

| | | | |
|---|---|---|---|
| 1075029 | 2/1960 | Fed. Rep. of Germany | 272/142 |
| 1173001 | 6/1964 | Fed. Rep. of Germany | 272/141 |
| 2063468 | 12/1977 | Fed. Rep. of Germany | 272/139 |
| 1183652 | 1/1959 | France | 272/73 |
| 317522 | 5/1934 | Italy | 272/137 |
| 1175446 | 12/1969 | United Kingdom | 272/142 |
| 1344828 | 1/1974 | United Kingdom | 272/141 |

*Primary Examiner*—Richard J. Apley

*Attorney, Agent, or Firm*—Seidel, Gonda, Goldhammer & Panitch

[57] ABSTRACT

The exercising device includes a rigid central rod having transverse rigid headers fixedly connected at the ends of the rod. At least two strands of extensible cord are attached at their end portions to the rod. At least one end portion of each strand is releasably secured to the rod whereby a large number of different exercising devices may be performed.

18 Claims, 26 Drawing Figures

FIG. 4
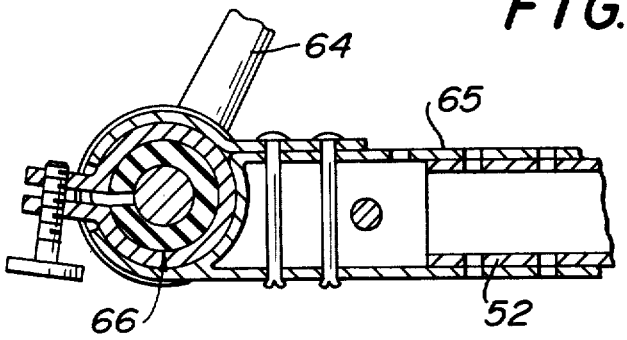
FIG. 5
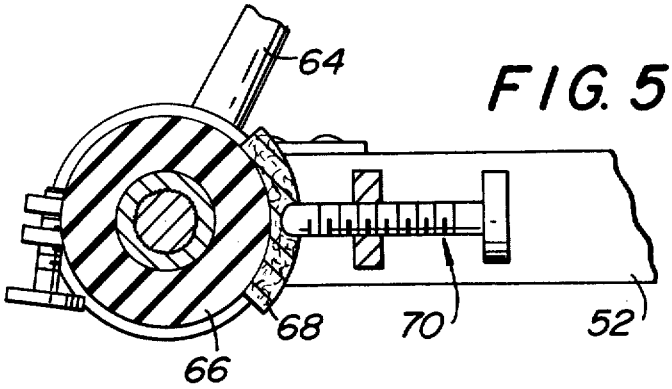
FIG. 7
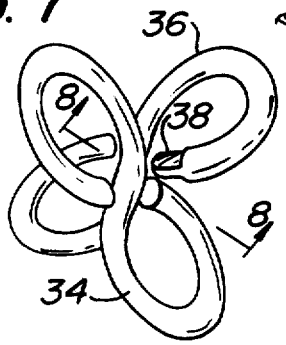
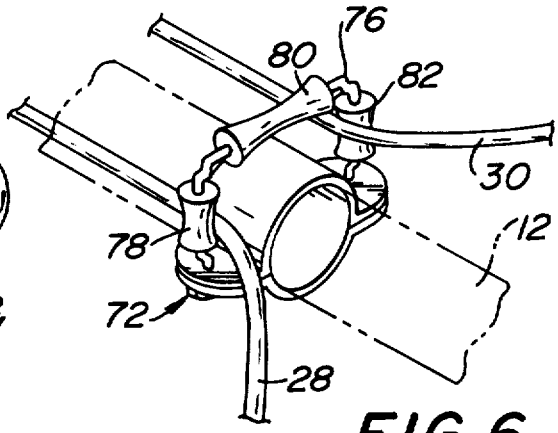
FIG. 6
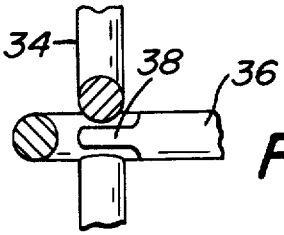
FIG. 8

FIG. 9
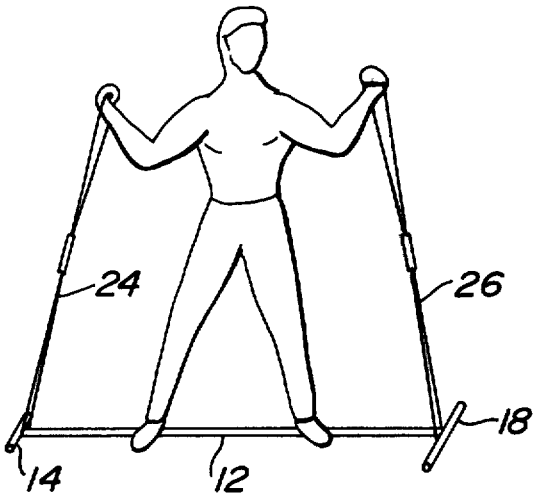
FIG. 10
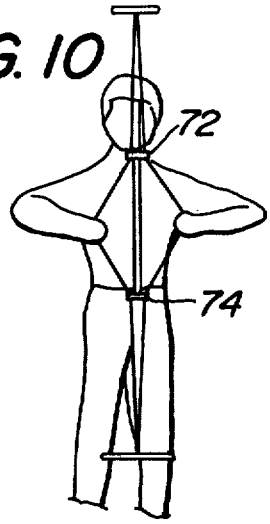
FIG. 11
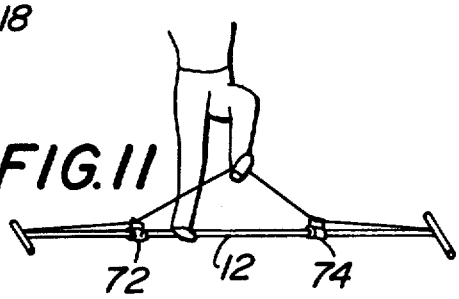
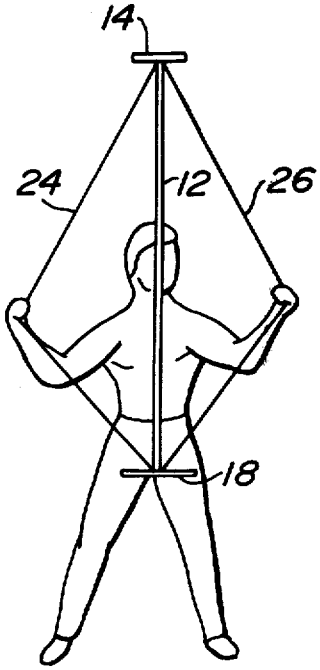
FIG. 12
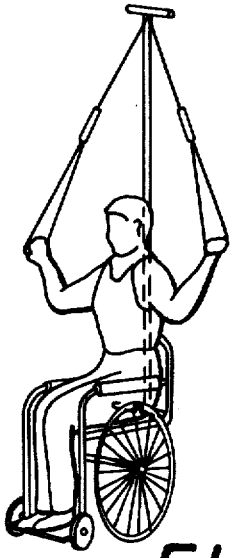
FIG. 13

FIG. 14
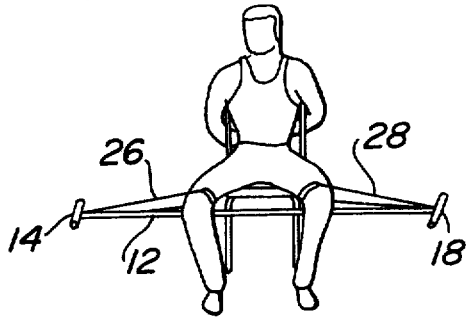
FIG. 15
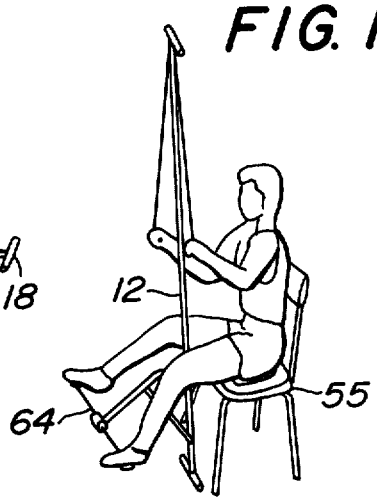
FIG. 23
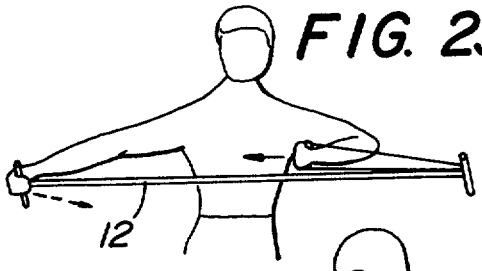
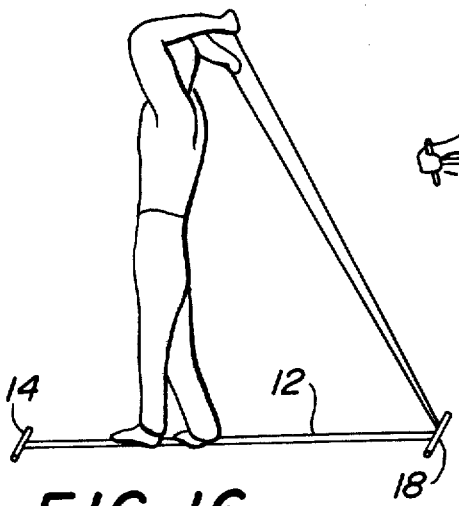
FIG. 16
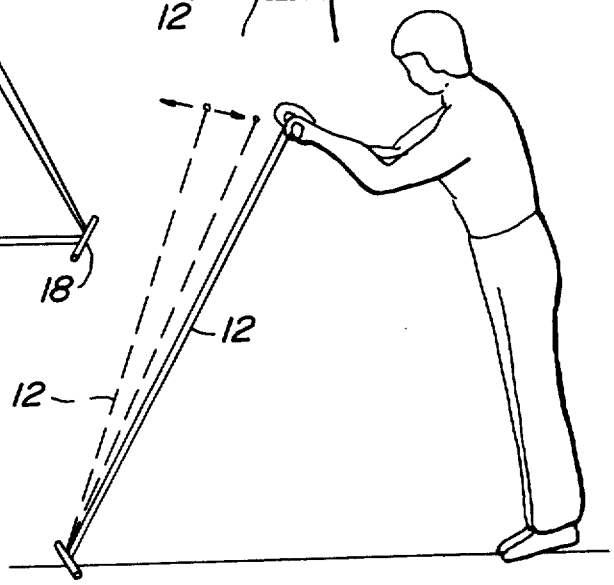
FIG. 17

FIG. 18
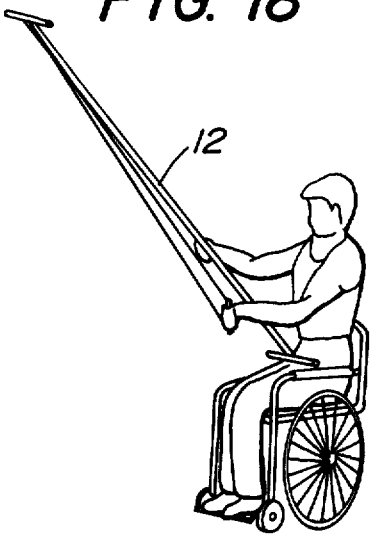
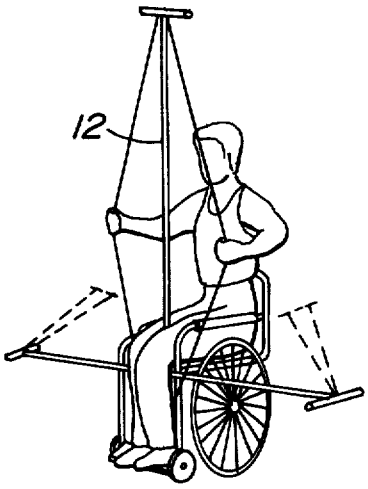
FIG. 19
FIG. 20
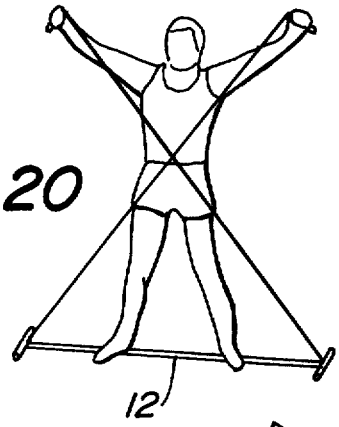
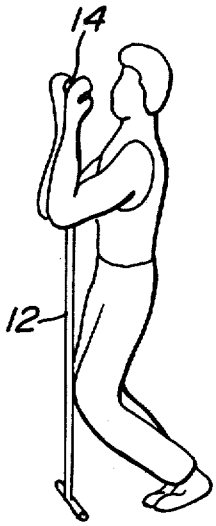
FIG. 21
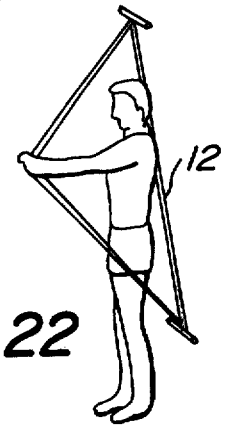
FIG. 22

FIG. 25
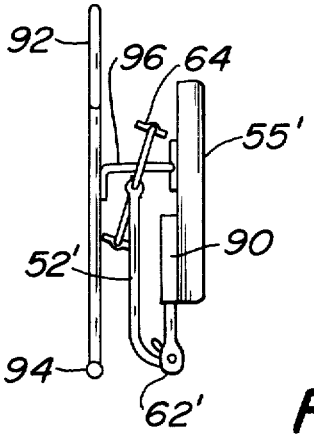
FIG. 24A
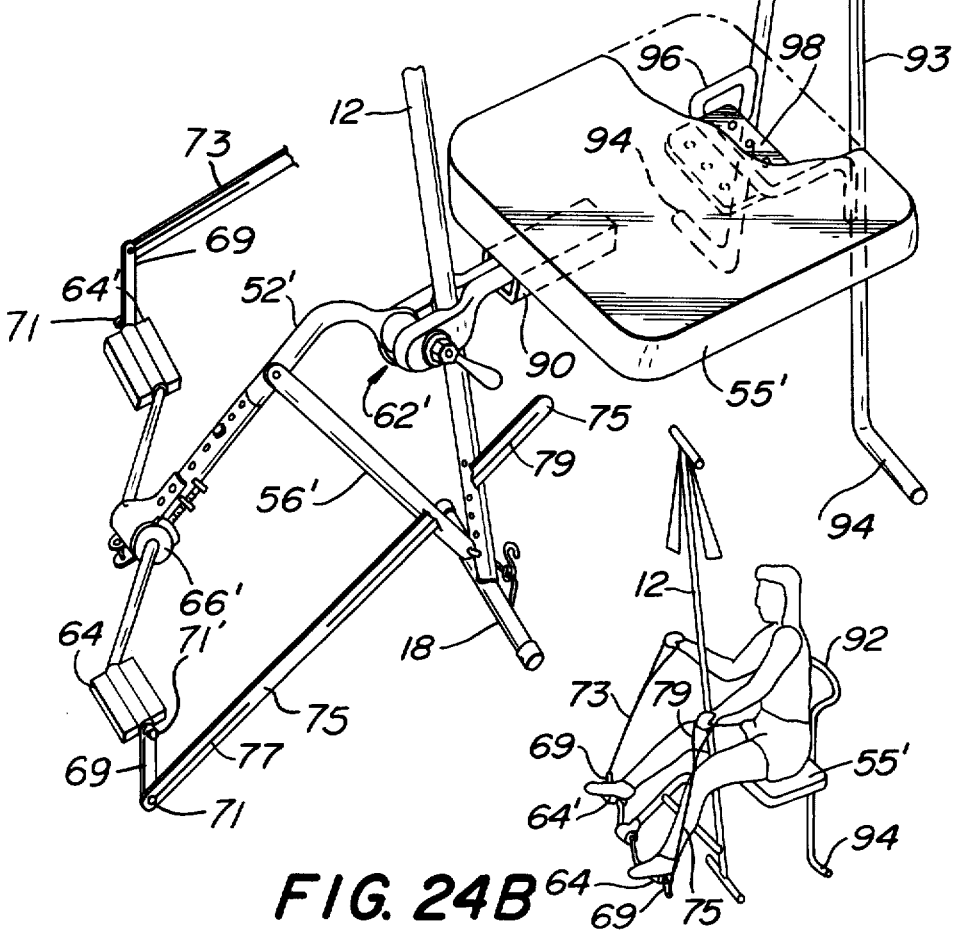
FIG. 24B

EXERCISING DEVICE

BACKGROUND

A large number of exercising devices have been preproposed heretofore. The devices of types shown in U.S. Pat. Nos. 3,268,225 and 3,746,339 appear to be the closest to the present invention. The present invention increases the number of exercises which can be attained while decreasing the number of moving parts. In said patents, the central member is comprised of telescoping tubes and the cords are nonextensible. The device in U.S. Pat. No. 3,369,809 bears a superficial resemblance to the present invention.

SUMMARY OF THE INVENTION

The exerciser of the present invention comprises a rigid central rod of fixed length. A rigid transverse header is fixedly connected to a least one of the ends of the rod. The headers are substantially shorter than the length of said rod. At least two strands of extensible cord are attached at their end portions to the rod. A means is provided for releasably securing at least one end portion of each strand to the rod. A handle is provided for use with each releasable cord end portion.

A preferred embodiment of the present invention is adapted to be attached to a frame having a seat portion and offset pedals so that the exercising device may be used while pedalling a simulated bycicle. Straps may be attached either to the pedals or to an extension of the pedals whereby arms and shoulders are simultaneously exercised by holding on to the straps while pedalling. The present invention is adapted to be used by occupants of wheelchairs or other handicapped persons. The exercising device of the present invention may be used for both isometric type exercises and isotonic type exercises.

It is an object of the present invention to provide a novel exercising device which has few moving parts while being capable of performing a larger number of exercises as compared with devices proposed heretofore.

Another object of the present invention is to provide an exercising device which is simple and reliable.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 4 is a sectional view taken along the line 4—4 in FIG. 2 but on an enlarged scale;

FIG. 5 is a sectional view taken along the line 5—5 in FIG. 2 but on an enlarged scale;

FIG. 6 is a perspective view of a tension adjusting clamp;

FIG. 7 is a perspective view of interlocking links;

FIG. 8 is a sectional view taken along the line 8—8 in FIG. 7;

FIGS. 9–23 show some of the many exercises which can be performed with the present invention.

Figures 2, 3:
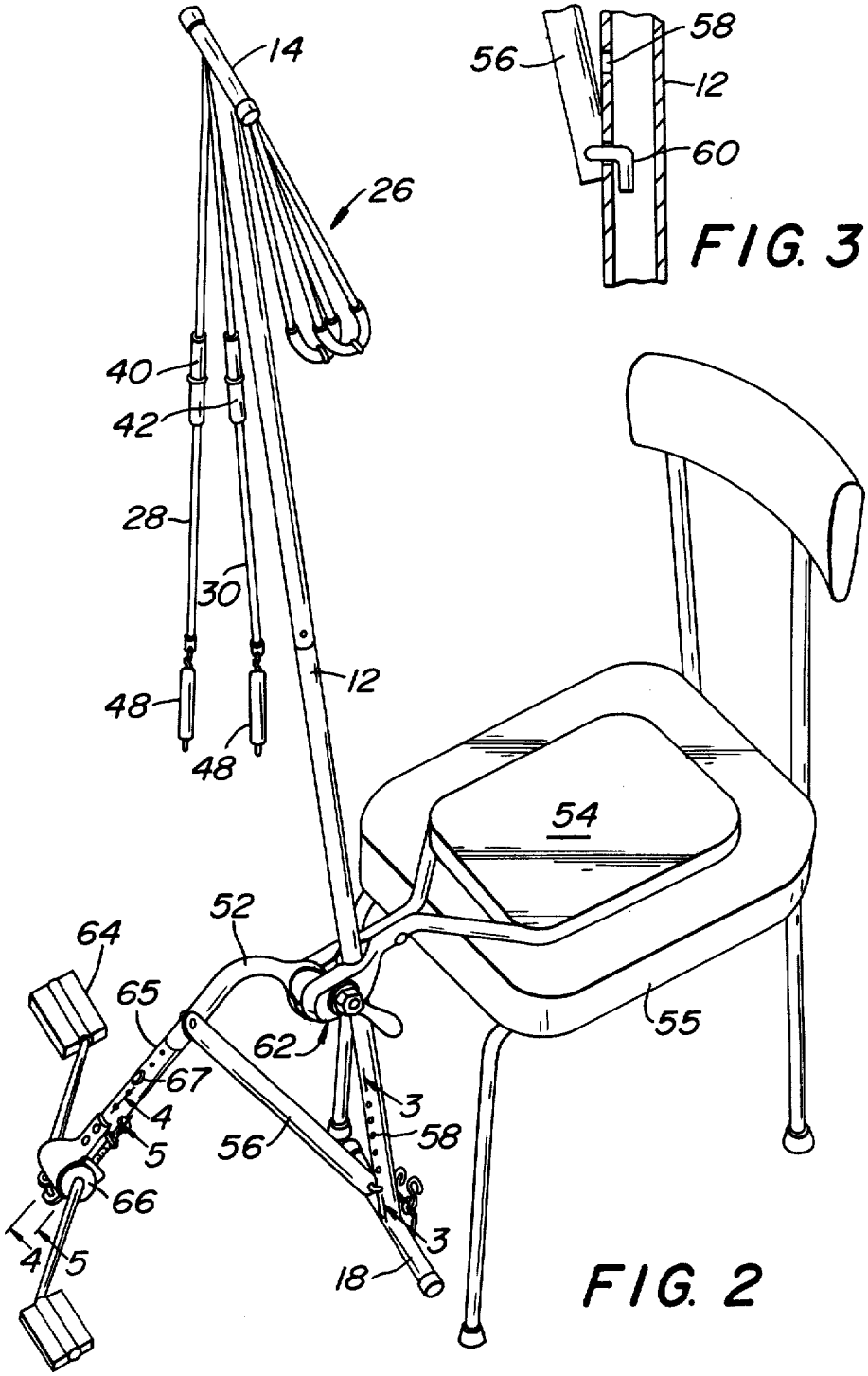
FIG. 2 is a perspective view of the device of the present invention arranged for simultaneous use with pedalling of a simulated bicycle.
FIG. 3 is a sectional view taken along the line 3—3 in FIG. 2 but on an enlarged scale.

FIGS. 24A and B are views similar to FIG. 2 but showing another embodiment;

FIG. 25 shows the chair and frame of FIG. 24A in a collapsed position for storage.

DETAILED DESCRIPTION

Figure 1:
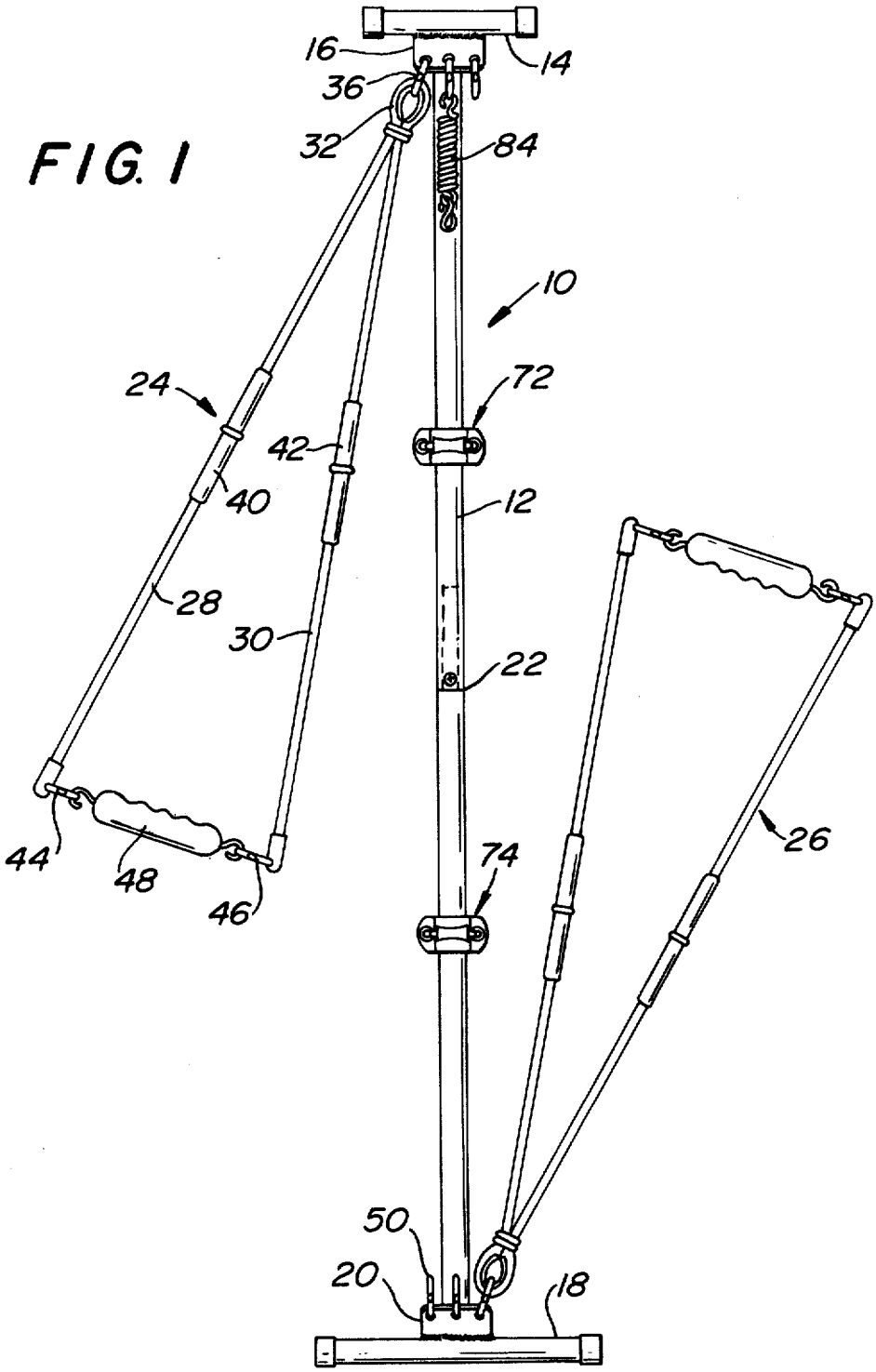
FIG. 1 is a perspective view of an exercising device in accordance with the present invention with the cords arranged for use in connection with a particular type of exercise.

Referring to the drawing in detail, wherein like numerals indicate like elements, there is shown in FIG. 1 an exercising device in accordance with the present invention designated generally as 10. The device 10 includes a rigid central rod of fixed length. Rod 12 has a transverse header 14 fixedly secured thereto at one end thereof by way of a bracket 16. A similar header 18 is connected to the other end of the rod 12 by bracket 20. Header 18 is longer than header 14. Headers 14 and 18 are substantially shorter than the length of the rod 12. The rod 12 may have a length of about 5 feet. If desired, the rod 12 may be made in two parts which are threaded or otherwise removably secured together at a telescoping joint 22 to thereby facilitate ease of storage and/or lengthening rod 12.

Two sets of cords are attached at their end portions to the brackets 16 and 20. The sets of cords 24 and 26 are identical. Hence, only said 24 will be described in detail. The set of cords 24 includes strands 28 and 30 of an extensible material such as an elastmeric material. In the preferred embodiment, the strands 28 and 30 are part of one elongated member folded back on itself at the loop 32. The loop 32 is releasably connected to the bracket 16 by a link 34 extending from the loop 32. See FIG. 7 and 8. Link 36 is connected through a hole in the bracket 16 and has a flat 38 adjacent to center thereof. The links 36 and 34 are generally of a shape corresponding to the numeral 8. When twisted at approximately at a 45° angle, the links may be releasably interconnected with one another but will have no tendancy to disengage during use of the device 10.

The other end of the strands 28 and 30 are provided with similar links 44 and 46 respectively. Each of the links 44 and 46 may be releasably connected to the link 50 on the bracket 20. Such would be the normal orientation of the components when the device 10 is not being used and the strands are under slight tension since they are slightly shorter than rod 12.

One manner in which the device 10 may be used is to disconnect one end portion of the set 24 from the bracket 20 and one end portion of the set 26 from the bracket 16. The free ends of the sets are then releasably interconnected by a rigid handle 48. With the rod 12 resting on the floor or other support surface, the device 10 as illustrated in FIG. 1 may be utilized to perform exercises as illustrated in FIG. 9. The central position of the strands 28 and 30 are respectively provided with flexible handles of plastic or similar material designated 40, 42.

The device 10 may be releasably coupled to a frame 52 as shown in FIG. 2 for use on a chair 55. Frame 52 has a seat portion 54 and a brace 56 pivotably connected thereto at one end of the brace. The other end of the brace 56 has a tongue 60 adapted to enter one of the holes 58 in the rod 12. See FIG. 2 and 3.

The frame 52 has a bearing 66 which supports a pair of offset pedals 64. The bearing 66 is attached to tube 65 which is adjustably clamped to the frame 52 by pin 67 to facilitate adjustment of the location of the pedals 64 with respect to the frame and seat portion 54. See FIG. 2. The arrangement in FIG. 2 permits simultaneous pedaling and isotonic exercises.

As shown in FIG. 5, a braking pressure may be applied to the bearing 66 to add a restraint to the ease with which the pedals 64 may be manipulated by the feet of a person using the present invention. A brake pad 68 embraces a portion of the bearing 66. The pressure between bearing 66 and pad 68 is adjustable by way of member 70 which is threadedly supported by the frame 52.

As shown in FIG. 1, a pair of clamps 72 and 74 are releasably and adjustably coupled to the rod 12. The clamps 72, 74 are identical. Hence, only clamp 72 will be described in detail. As shown in FIG. 6, clamp 72 as a pair of cylindrical portions embracing the rod 12 with ears on opposite sides thereof. A threaded retainer interconnects one of the sets of ears so as to facilitate loosening of the clamp 72 and sliding the same along the length of the rod 12 to a desired position.

The clamp 72 includes a U-shaped support 76 with an offset between the bight and each of the leg portions. One leg portion supports roller 78, the other leg portion supports roller 82 and the bight supports roller 80. The rollers 78, 80 and 82 are preferably provided with a concave periphery and may be made from a convenient inexpensive material such as a polymeric plastic. The strands 28 and/or 30 are selectively insertable through the clamp 72 in the manner as illustrated in FIG. 6 or with both of the strands engaging roller 80. Clamp 72 provides a means for restraining the extensibility of the cords as shown in FIGS. 10, 11. The closer the clamps 72 and 74 are to one another, the greater force is needed to extend the strands 28 and 30. The strands 28 and 30 may be manipulated as a set or individually. Use of clamps 72, 74 is optional.

The device 10 of the present invention may be utilized for isotonic exercises in a variety of different ways such as those illustrated in FIGS. 9–16, 18–20 and 23. The device of the present invention facilitates exercising by persons who are handicapped. The device 10 may be utilized for isometric exercises as shown in FIGS. 17 and 21. The various types of exercises illustrated in FIGS. 9–23 are for purposes of illustration and only represent a portion of the types of exercises and alternative variations in using the device of the present invention for exercising arms, legs, shoulders, waist, back, etc.

The device 10 of the present invention is capable of being utilized by a wide range of different sized persons. The clamps 72, 74 constitute a means for restraining the effective length of the cords 28, 30. A spring 84 is releasably connected by a link at one end to the bracket 16. A link at the other end of the spring may be releasably interconnected with the loop 32 and thereby extend the extensibility of the set 24. It will be noted that the sets of cords need not be disconnected from one end of the rod 12 in connection with some of the exercises while opposite ends are disconnected from the rod 12 when exercising as shown in FIG. 20 or the sets are disconnected from the same end of the rod 12 when exercising as shown in FIG. 16. The handles 40, 42 may be utilized when exercising as shown in FIGS. 2, 14 and 15. Thus, the present invention provides an extremely versatile and unique exercising device.

In FIG. 24A the device 10 is shown in combination with a frame and chair arrangement similar to that in FIG. 2 but capable of being collapsed for storage as shown in FIG. 25. Corresponding elements have primed numerals in FIG. 24A and will not be described in detail.

In FIG. 24A the frame 52' extends into and is releasably and adjustably secured to a channel 90 on the bottom of seat portion 55'. A seat frame 92 has upright legs 93 terminating in horizontal floor engaging portions 94. A U-shaped bracket 96 is secured to the frame legs 93 and its bight is pivotably connected to the bottom of seat portion 55' by hinge 98. In the operative position, the seat portion 55' in part rests on bracket 96.

As shown in FIG. 24B, pedalling may be combined with hand and body exercises. In this regard, each pedal has an integral perpendicular extension 69. Each extension 69 has at least one strap attachment means. As shown in FIG. 24A, each extension 69 has two strap attachment means in the form of buttons designated 71 and 71'. Each of the buttons is selectively coupled with a slit 77 adjacent one end of the flexible straps 73, 75. The other end of each strap is held in a separate hand of the person doing the pedalling. By having button 71' at the axis of pedals 64 and button 71 spaced from the axis the pedals 64, the "throw" or pull on each strap can be varied. The straps 73, 75 preferably have a slit 79 which forms a loop for holding the straps. The slits 77 can be formed into a loop which embraces the pedals 64 directly if desired.

The present invention may be embodied in other specific forms without departing from the spirit or essential attributes thereof and, accordingly, reference should be made to the appended claims, rather than to the foregoing specification, as indicating the scope of the invention.

I claim:

1. An exerciser comprising a rigid central rod, a rigid transverse header fixedly secured to at least one of the end portions of said rod, said header being generally perpendicular to said rod and being substantially shorter than said rod, at least two strands of extensible cord each releasably attached at their end portions to opposite end portions of said rod to thereby define one disposition wherein said strands are generally parallel to said rod, means at a first end portion of said rod for releasably securing both end portions of one strand thereto, and means at the opposite end portion of the rod for releasably securing both ends of the other strand thereto to thereby define a second disposition of said strands relative to said rod.

2. An exerciser in accordance with claim 1 including a rigid handle for use with each releasable cord end portion.

3. An exerciser in accordance with claim 1 wherein the releasable securing means for one strand is at one end of the rod and the releasable securing means for the other strand is at the other end of the rod.

4. An exerciser in accordance with claim 1 including flexible handles surrounding said cords adjacent the central portion thereof.

5. An exerciser in accordance with claim 1 including means engaging said strands and shiftable along said rod for adjusting the effective operative length of each strand.

6. An exerciser in accordance with claim 1 including a spring releasably interconnecting one end portion of a strand and one end portion of said rod.

7. An exerciser in accordance with claim 1 wherein each strand is comprised of two cords releasably coupled end to end.

8. An exerciser having a rigid central rod of fixed length, a rigid transverse header fixedly connected at each end of said rod, said headers being substantially shorter than said rod and generally perpendicular thereto, two sets of strands of extensible elastomeric cord attached at their end portions to a bracket means on said rod adjacent the ends thereof, flexible handle grips on each strand in a central portion thereof, means for releasably securing each end of each strand to one of said bracket means.

9. An exerciser in accordance with claim 8 including first and second clamps shiftable along said rod for selectively adjusting the effective operative length of each strand.

10. An exerciser in accordance with claim 9 wherein said clamps each include at least one concave roller for contact with at least one of said strands.

11. An exerciser in accordance with claim 8 including a frame having a seat portion, and said frame having feet maniputable pedals releasably interconnected with said rod to facilitate simultaneous pedalling and isotonic exercises.

12. An exerciser in accordance with claim 11 wherein said pedals and seat portion are connected to the frame in a manner that permits collapsing of the same for purposes of storage.

13. An exerciser in accordance with claim 11 including a pair of flexible straps, each strap having one end releasably coupled to an extension on each pedal for movement therewith.

14. An exerciser in accordance with claim 8 wherein said last mentioned means includes links having a shape corresponding generally to the numeral 8 and constructed for attachment and release only when in mutually perpendicular planes.

15. An exerciser comprising a seat portion supported by a frame, foot pedals supported by said frame, at least one of said seat portion and pedals being adjustable relative to the frame, a pair of straps, each strap having a hand grasping portion at one end and attachment means at its other end, each attachment means being removably coupled to a discrete pedal so that the straps are alternately pulled by the pedalling movement of said pedals.

16. An exerciser in accordance with claim 15 wherein each attachment means is a slit in each strap.

17. An exerciser comprising a rigid central rod, a rigid transverse header fixedly connected to at least one of the end portions of said rod, said header being substantially shorter than said rod, at least two strands of extensible cord attached at their end portions to said rod, means for releasably securing at least one end portion of each strand to said rod, a seat and offset foot pedals connected to a frame, means for connecting said frame to said rod to facilitate dual exercises of pedalling and isotonic exercises with said strands.

18. An exerciser in accordance with claim 17 including means on said frame for adjusting the ease with which the foot pedals may be manipulated.

* * * * *